US009748717B2

(12) United States Patent
Lewis et al.

(10) Patent No.: US 9,748,717 B2
(45) Date of Patent: Aug. 29, 2017

(54) SYSTEMS AND METHODS FOR PROVIDING A COMBINATION CONNECTOR ASSEMBLY IN AN INFORMATION HANDLING SYSTEM

(71) Applicant: Dell Products L.P., Round Rock, TX (US)

(72) Inventors: Jonathan Foster Lewis, Pflugerville, TX (US); Corey Dean Hartman, Hutto, TX (US); Andrew Lafayette McAnally, Georgetown, TX (US)

(73) Assignee: Dell Products L.P., Round Rock, TX (US)

( * ) Notice: Subject to any disclaimer, the term of this patent is extended or adjusted under 35 U.S.C. 154(b) by 0 days.

(21) Appl. No.: 14/935,619

(22) Filed: Nov. 9, 2015

(65) Prior Publication Data

US 2017/0133805 A1 May 11, 2017

(51) Int. Cl.

| | |
|---|---|
| ***H01R 27/00*** | (2006.01) |
| ***H01R 24/64*** | (2011.01) |
| *H01R 107/00* | (2006.01) |
| *H01R 13/453* | (2006.01) |
| *H01R 31/06* | (2006.01) |

(Continued)

(52) U.S. Cl.

CPC ..... *H01R 27/00* (2013.01); *H01R 24/64* (2013.01); *H01R 9/0506* (2013.01); *H01R 13/447* (2013.01); *H01R 13/453* (2013.01); *H01R 13/4532* (2013.01); *H01R 13/4534* (2013.01);

(Continued)

(58) Field of Classification Search

CPC H01R 13/453; H01R 13/447; H01R 13/4532; H01R 13/4534; H01R 9/0506; H01R 31/06; H01R 25/00

USPC ..... 439/135, 136, 137, 138, 139, 140, 141, 439/142, 638, 639, 676, 131

See application file for complete search history.

(56) References Cited

U.S. PATENT DOCUMENTS 4,957,831 A * 9/1990 Meredith ..... H01H 9/0011 307/150

2007/0224859 A1 9/2007 Sasser et al.

(Continued)

OTHER PUBLICATIONS

International Search Report and Written Opinion of the International Searching Authority, International Application No. PCT/US2016/059927, mailed Jan. 19, 2017.

*Primary Examiner* — Abdullah Riyami
*Assistant Examiner* — Justin Kratt
(74) *Attorney, Agent, or Firm* — Jackson Walker L.L.P.

(57) ABSTRACT

A combination connector may include a first connector housed within a housing and configured to be communicatively coupled to an information handling resource, the first connector configured to receive connectors of a first form factor and to communicatively couple a corresponding connector of the first form factor received by the first connector to the information handling resource, and a second connector housed within the housing and configured to be communicatively coupled to the information handling resource, the second connector configured to receive connectors of a second form factor and to communicatively couple a corresponding connector of the second form factor received by the second connector to the information handling resource. A first footprint of the corresponding connector of the first form factor as engaged with the first connector may be overlapping with a second footprint of the corresponding connector of the second form factor as engaged with the second connector.

24 Claims, 8 Drawing Sheets

(51) Int. Cl.

| | |
|---|---|
| *H01R 9/05* | (2006.01) |
| *H01R 13/447* | (2006.01) |
| *H01R 25/00* | (2006.01) |
| *H01R 24/54* | (2011.01) |

(52) U.S. Cl.
CPC ..... *H01R 24/54* (2013.01); *H01R 25/00* (2013.01); *H01R 31/06* (2013.01); *H01R 2107/00* (2013.01)

(56) References Cited

U.S. PATENT DOCUMENTS

| | | | | |
|---|---|---|---|---|
| 2009/0137137 | A1* | 5/2009 | Jeong ..... | H01R 29/00 439/131 |
| 2010/0014566 | A1 | 1/2010 | Mezer et al. | |
| 2012/0071011 | A1* | 3/2012 | Kagan ..... | H01R 31/065 439/76.1 |
| 2015/0277070 | A1 | 10/2015 | Luo et al. | |

* cited by examiner

SYSTEMS AND METHODS FOR PROVIDING A COMBINATION CONNECTOR ASSEMBLY IN AN INFORMATION HANDLING SYSTEM

TECHNICAL FIELD

The present disclosure relates in general to information handling systems, and more particularly to systems and methods for providing a combination connector for receiving multiple types of corresponding connectors.

BACKGROUND

As the value and use of information continues to increase, individuals and businesses seek additional ways to process and store information. One option available to users is information handling systems. An information handling system generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

In an information handling system, various connectors are often used to electrically couple the various components of the information handling system to one another. In some embodiments, such connectors may include external connectors having features externally facing from a chassis for housing components of the information handling system, thus allowing external devices and/or cables to be coupled externally to the information handling system. For example, external connectors may include connectors for coupling a cable to a network interface of an information handling system. Network connectors may take on a variety of form factors, including without limitation a female jack (oftentimes referred to as an RJ45 jack) for receiving an Ethernet over twisted pair cable (e.g., category 5 cable) and a female connector for a small form-factor pluggable (SFP) transceiver. Oftentimes, a manufacturer of information handling systems may have little or no certainly as to the type of network connector and end user may desire, and thus, to provide the most flexibility to a customer, may include multiple network connectors (e.g., at least one SFP connector in its own assembly and at least one RJ45 jack in its own assembly). However, provision of multiple connectors may require a significant amount of space, which may be problematic as dimensions of information handling systems continue to shrink.

SUMMARY

In accordance with the teachings of the present disclosure, the disadvantages and problems associated with having multiple external connectors for an information handling system may be reduced or eliminated.

In accordance with embodiments of the present disclosure, an information handling system may include a processor, an information handling resource communicatively coupled to the processor, and a combination connector. The combination connector may include a housing, a first connector housed within the housing and communicatively coupled to the information handling resource, the first connector configured to receive corresponding connectors of a first form factor and to communicatively couple a corresponding connector of the first form factor received by the first connector to the information handling resource, and a second connector housed within the housing and communicatively coupled to the information handling resource, the second connector configured to receive corresponding connectors of a second form factor and to communicatively couple a corresponding connector of the second form factor received by the second connector to the information handling resource. A first footprint of the corresponding connector of the first form factor as engaged with the first connector may be overlapping with a second footprint of the corresponding connector of the second form factor as engaged with the second connector.

In accordance with these and other embodiments of the present disclosure, a combination connector may include a housing, a first connector housed within the housing and configured to be communicatively coupled to an information handling resource, the first connector configured to receive corresponding connectors of a first form factor and to communicatively couple a corresponding connector of the first form factor received by the first connector to the information handling resource, and a second connector housed within the housing and configured to be communicatively coupled to the information handling resource, the second connector configured to receive corresponding connectors of a second form factor and to communicatively couple a corresponding connector of the second form factor received by the second connector to the information handling resource. A first footprint of the corresponding connector of the first form factor as engaged with the first connector may be overlapping with a second footprint of the corresponding connector of the second form factor as engaged with the second connector.

In accordance with these and other embodiments of the present disclosure, a method may include housing a first connector within a housing wherein the first connector is configured to be communicatively coupled to an information handling resource, and the first connector is further configured to receive corresponding connectors of a first form factor and to communicatively couple a corresponding connector of the first form factor received by the first connector to the information handling resource and housing a second connector within the housing and wherein the second connector is configured to be communicatively coupled to the information handling resource, and the second connector is further configured to receive corresponding connectors of a second form factor and to communicatively couple a corresponding connector of the second form factor received by the second connector to the information handling resource. The first connector and the second connector are housed such that a first footprint of the corresponding connector of the first form factor as engaged with the first connector may be overlapping with a second footprint of the corresponding connector of the second form factor as engaged with the second connector.

Technical advantages of the present disclosure may be readily apparent to one skilled in the art from the figures, description and claims included herein. The objects and advantages of the embodiments will be realized and achieved at least by the elements, features, and combinations particularly pointed out in the claims.

It is to be understood that both the foregoing general description and the following detailed description are examples and explanatory and are not restrictive of the claims set forth in this disclosure.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION

Figure 1:
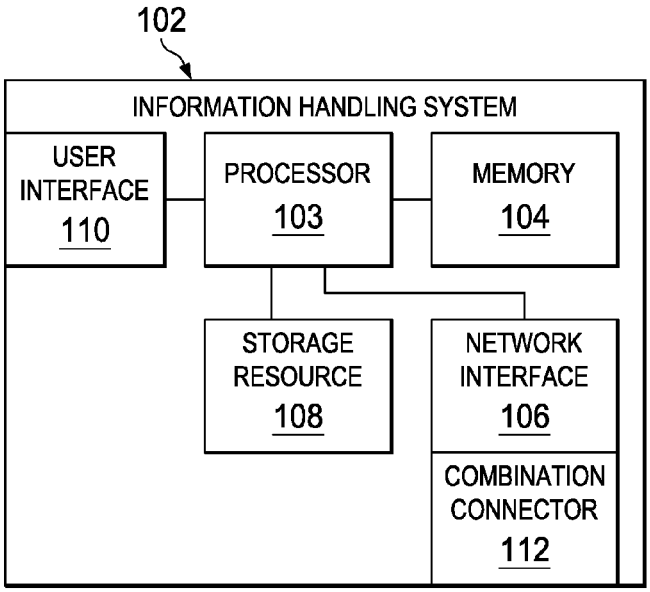
FIG. 1 illustrates a block diagram of selected components of an example information handling system, in accordance with embodiments of the present disclosure.

Preferred embodiments and their advantages are best understood by reference to FIGS. 1 through 7B, wherein like numbers are used to indicate like and corresponding parts.

For the purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, entertainment, or other purposes. For example, an information handling system may be a personal computer, a personal digital assistant (PDA), a consumer electronic device, a network storage device, or any other suitable device and may vary in size, shape, performance, functionality, and price. The information handling system may include memory, one or more processing resources such as a central processing unit ("CPU") or hardware or software control logic. Additional components of the information handling system may include one or more storage devices, one or more communications ports for communicating with external devices as well as various input/output ("I/O") devices, such as a keyboard, a mouse, and a video display. The information handling system may also include one or more buses operable to transmit communication between the various hardware components.

For the purposes of this disclosure, computer-readable media may include any instrumentality or aggregation of instrumentalities that may retain data and/or instructions for a period of time. Computer-readable media may include, without limitation, storage media such as a direct access storage device (e.g., a hard disk drive or floppy disk), a sequential access storage device (e.g., a tape disk drive), compact disk, CD-ROM, DVD, random access memory (RAM), read-only memory (ROM), electrically erasable programmable read-only memory (EEPROM), and/or flash memory; as well as communications media such as wires, optical fibers, microwaves, radio waves, and other electromagnetic and/or optical carriers; and/or any combination of the foregoing.

For the purposes of this disclosure, information handling resources may broadly refer to any component system, device or apparatus of an information handling system, including without limitation processors, service processors, basic input/output systems (BIOSs), buses, memories, I/O devices and/or interfaces, storage resources, network interfaces, motherboards, and/or any other components and/or elements of an information handling system.

For the purposes of this disclosure, circuit boards may broadly refer to printed circuit boards (PCBs), printed wiring boards (PWBs), printed wiring assemblies (PWAs) etched wiring boards, and/or any other board or similar physical structure operable to mechanically support and electrically couple electronic components (e.g., packaged integrated circuits, slot connectors, etc.). A circuit board may comprise a substrate of a plurality of conductive layers separated and supported by layers of insulating material laminated together, with conductive traces disposed on and/or in any of such conductive layers, with vias for coupling conductive traces of different layers together, and with pads for coupling electronic components (e.g., packaged integrated circuits, slot connectors, etc.) to conductive traces of the circuit board.

FIG. 1 illustrates a functional block diagram of selected components of an example information handling system 102, in accordance with embodiments of the present disclosure. In some embodiments, information handling system 102 may be a personal computer (e.g., a desktop computer or a portable computer). In other embodiments, information handling system 102 may comprise a storage server for archiving data.

As depicted in FIG. 1, information handling system 102 may include a processor 103, a memory 104 communicatively coupled to processor 103, a network interface 106 communicatively coupled to processor 103, a storage resource 108 communicatively coupled to processor 103, a user interface 110 communicatively coupled to processor 103, and a combination connector 112 communicatively coupled to network interface 106.

Processor 103 may include any system, device, or apparatus configured to interpret and/or execute program instructions and/or process data, and may include, without limitation, a microprocessor, microcontroller, digital signal processor (DSP), application specific integrated circuit (ASIC), or any other digital or analog circuitry configured to interpret and/or execute program instructions and/or process data. In some embodiments, processor 103 may interpret and/or execute program instructions and/or process data stored in memory 104, storage resource 108, and/or another component of information handling system 102.

Memory 104 may be communicatively coupled to processor 103 and may include any system, device, or apparatus configured to retain program instructions and/or data for a period of time (e.g., computer-readable media). Memory 104 may include random access memory (RAM), electrically erasable programmable read-only memory (EEPROM), a PCMCIA card, flash memory, magnetic storage, opto-magnetic storage, or any suitable selection and/or array of volatile or non-volatile memory that retains data after power to its associated information handling system 102 is turned off.

Network interface 106 may comprise any suitable system, apparatus, or device operable to serve as an interface between information handling system 102 to one or more other information handling systems via a network. Network interface 106 may enable primary information handling system 102 to communicate using any suitable transmission protocol and/or standard. In these and other embodiments, network interface 106 may comprise a network interface card, or "NIC." In other embodiments, network interface 106 may be implemented as a virtual NIC (e.g., implemented by software configured to execute on processor 103 of information handling system 102).

Storage resource 108 may include any system, device, or apparatus configured to store data. Storage resource 108 may include one or more hard disk drives, magnetic tape libraries, optical disk drives, magneto-optical disk drives, solid state storage drives, compact disk drives, compact disk arrays, disk array controllers, and/or any other systems, apparatuses or devices configured to store data. In certain embodiments, storage resource 108 may include one or more storage enclosures configured to hold and/or power one or more of such devices. In the embodiments represented by FIG. 1, storage resource 108 may reside within information handling system 102. However, in other embodiments, storage resource 108 may reside external to information handling system 102 (e.g., may be coupled to information handling system 102 via a network).

User interface 110 may comprise any instrumentality or aggregation of instrumentalities by which a user may interact with information handling system 102. For example, user interface 110 may permit a user to input data and/or instructions into information handling system 102, and/or otherwise manipulate information handling system 102 and its associated components. User interface 110 may also permit information handling system 102 to communicate data to a user, e.g., by way of a display device.

Combination connector 112 may comprise an electrical connector in the form of a jack or socket for receiving multiple form factors of corresponding connectors. Such corresponding connectors may include one or more corresponding terminated cables (e.g., cable terminated in a plug) and/or other connectors that mate with a geometry of combination connector 112. In particular embodiments, as described in greater detail below, combination connector 112 may be configured to receive either of a plug-terminated Ethernet over twisted pair (e.g., category 5) cable and a small form-factor pluggable (SFP) (e.g., optical fiber) cable.

In addition to processor 103, memory 104, network interface 106, storage resource 108, user interface 110, and combination connector 112, information handling system 102 may include one or more other information handling resources. Such an information handling resource may include any component system, device or apparatus of an information handling system, including without limitation, a processor, bus, memory, I/O device and/or interface, storage resource (e.g., hard disk drives), network interface, electromechanical device (e.g., fan), display, power supply, and/or any portion thereof. An information handling resource may comprise any suitable package or form factor, including without limitation an integrated circuit package or a printed circuit board having mounted thereon one or more integrated circuits.

Figure 2A:
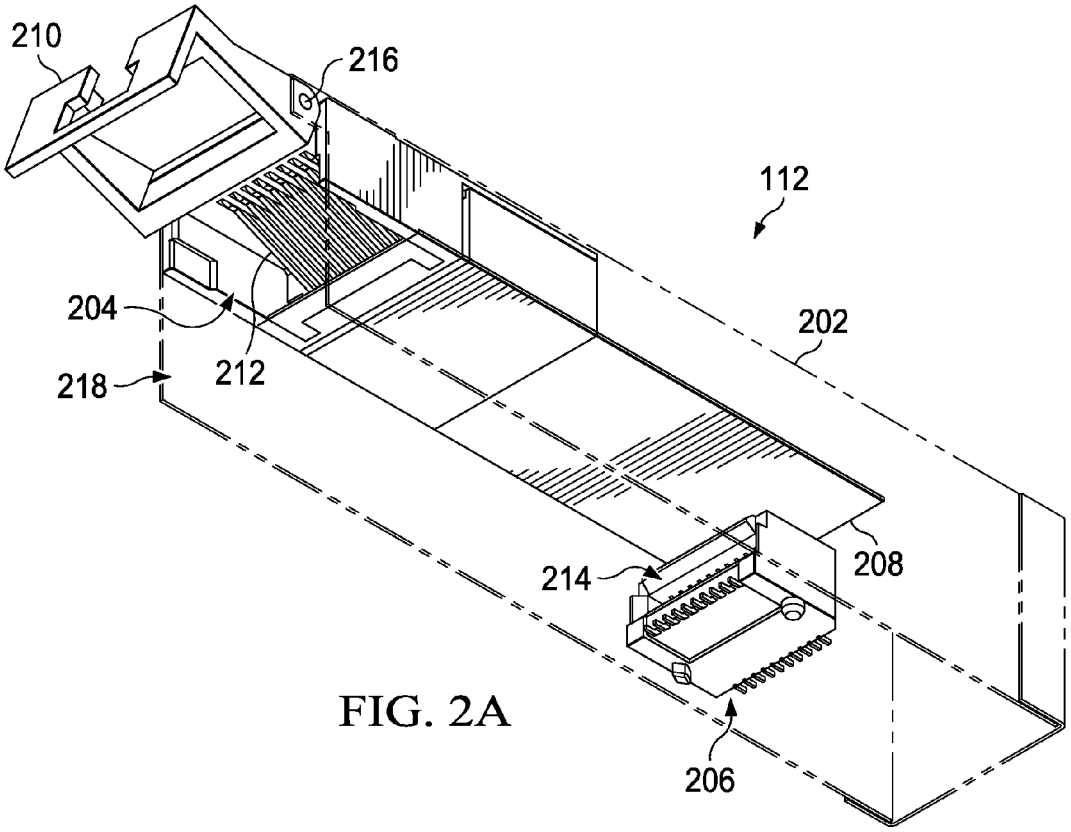
FIGS. 2A and 2B illustrate two different perspective views of an example combination connector, in accordance with embodiments of the present disclosure.
Figure 2B:
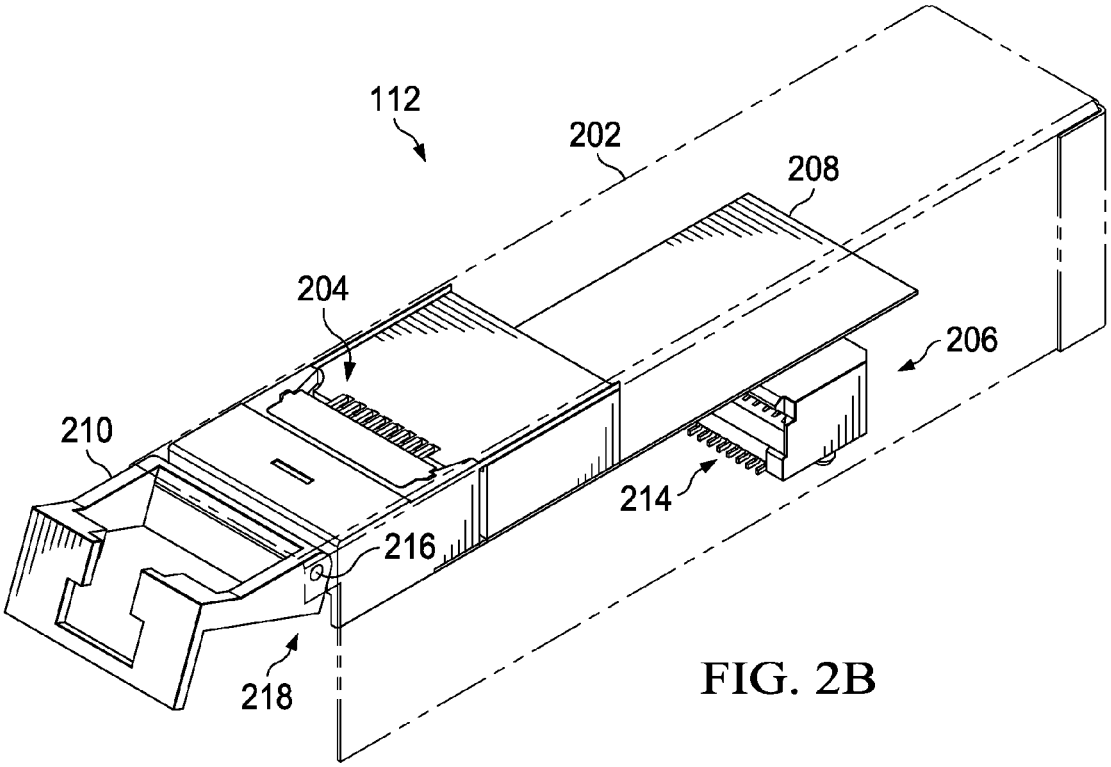

FIGS. 2A and 2B illustrate two different perspective views of an example combination connector 112, in accordance with embodiments of the present disclosure. As shown in FIGS. 2A and 2B, combination connector 112 may include a housing 202 to house components of combination connector 112 and/or provide mechanical structure for mechanically supporting combination connector 112 when disposed in an information handling system 102. Housing 202 may therefore comprise metal, plastic, or any other structural material for mechanically supporting components of combination connector 112.

As shown in FIGS. 2A and 2B, combination connector 112 may include a first connector 204 which may include a female connector (sometimes also known as an "RJ45 jack") for receiving a plug-terminated Ethernet over twisted pair (e.g., category 5) cable and a second connector 206 which may include a female connector for receiving a corresponding male SFP connector. Each of first connector 204 and second connector 206 may be electrically coupled to a circuit board 208. In some embodiments, circuit board 208 may be communicatively coupled to network interface 106. In other embodiments, network interface 106 may comprise circuit board 208.

As shown in FIGS. 2A and 2B, first connector 204 and second connector 206 may be located at distal ends of housing 202, thus allowing pins 212 of first connector 204 and pins 214 of second connector 206 to be positioned away from one another, thus potentially preventing inadvertent contact of pins.

Also as shown in FIGS. 2A and 2B, combination connector 112 may include a movable portion 210 at an opening 218 of housing 202 which may be rotatably coupled to housing 202 via an axis 216, as shown. As described in greater detail below, movable portion 210 may be positioned so as to define an identity of combination connector 112. For example, in one position (see, e.g., FIG. 3), movable portion 210 may include features for mechanically guiding and/or latching connectors having a first form factor in order to mechanically and electrically couple such connectors to first connector 204 and/or may include features for preventing connectors having a second form factor corresponding to second connector 206 from being inserted into combination connector 112. In a second position (see, e.g., FIG. 4) movable portion 210 may allow connectors having the second form factor and corresponding to second connector 206 to be inserted into combination connector 112 while preventing connectors having the first form factor corresponding to first connector 204 from being inserted into combination connector 112.

Figure 3:
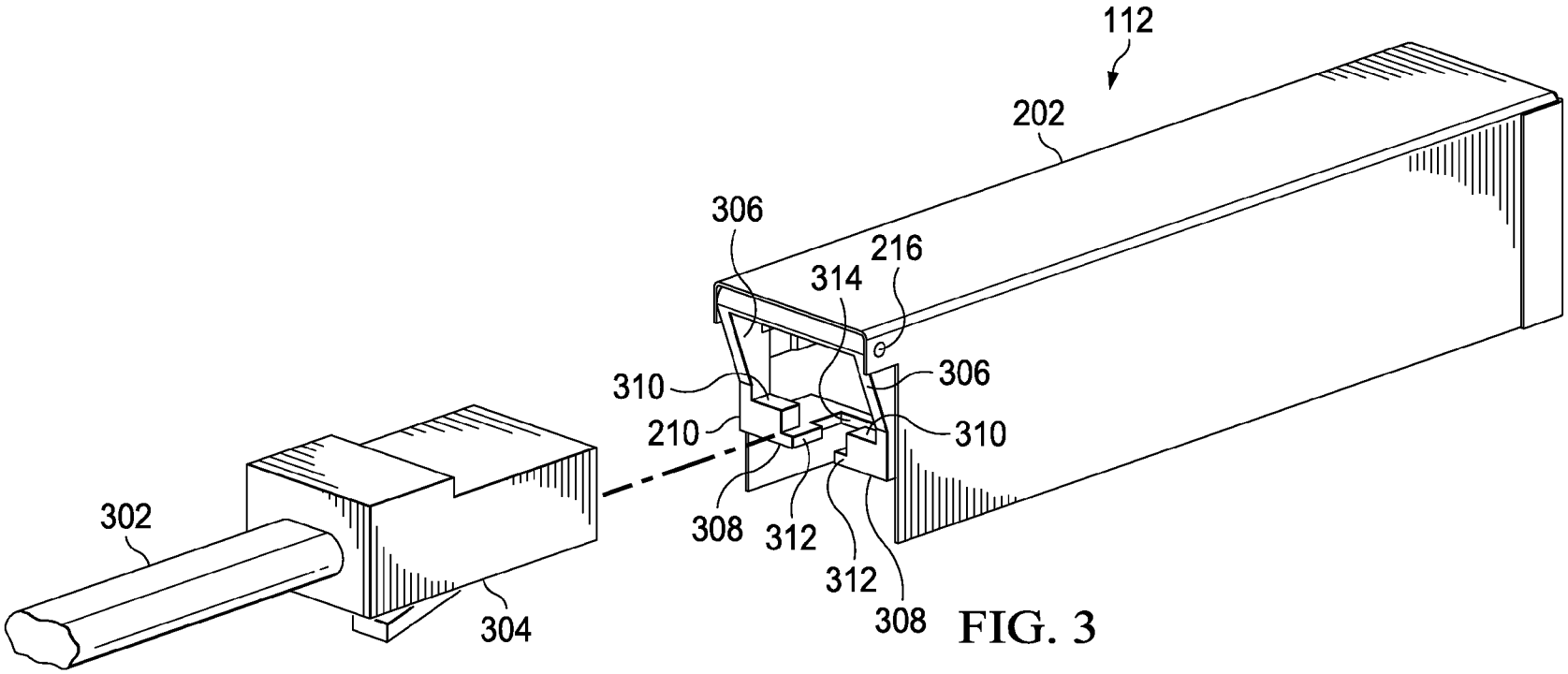
FIG. 3 illustrates a perspective view of the combination connector of FIGS. 2A and 2B with a movable portion in a first position, in accordance with embodiments of the present disclosure.

FIG. 3 illustrates a perspective view of combination connector 112 with movable portion 210 in a first position, in accordance with embodiments of the present disclosure. As shown in FIG. 3, in the first position movable portion 210 may include features 306, 308, 310, 312, and 314 for mechanically guiding, gathering, and/or latching connectors having a first form factor (e.g., an Ethernet over twisted pair cable 302 terminated with a plug 304) in order to mechanically and electrically couple such connectors to first connector 204 and/or may include features for preventing connectors having a second form factor corresponding to second connector 206 from being inserted into combination connector 112.

Figure 4:
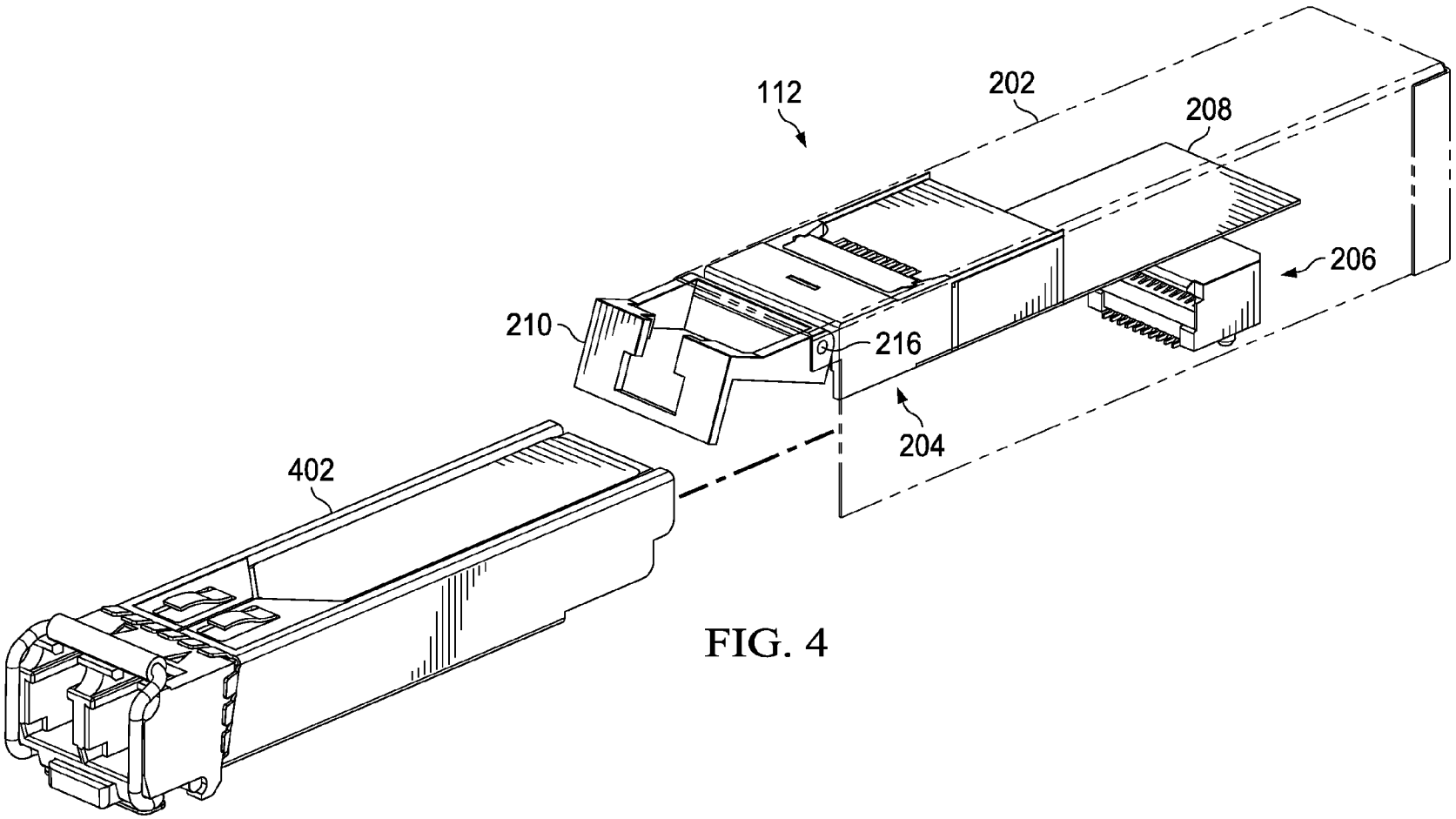
FIG. 4 illustrates a perspective view of the combination connector of FIGS. 2A and 2B with a movable portion in a second position, in accordance with embodiments of the present disclosure.
Figure 5:
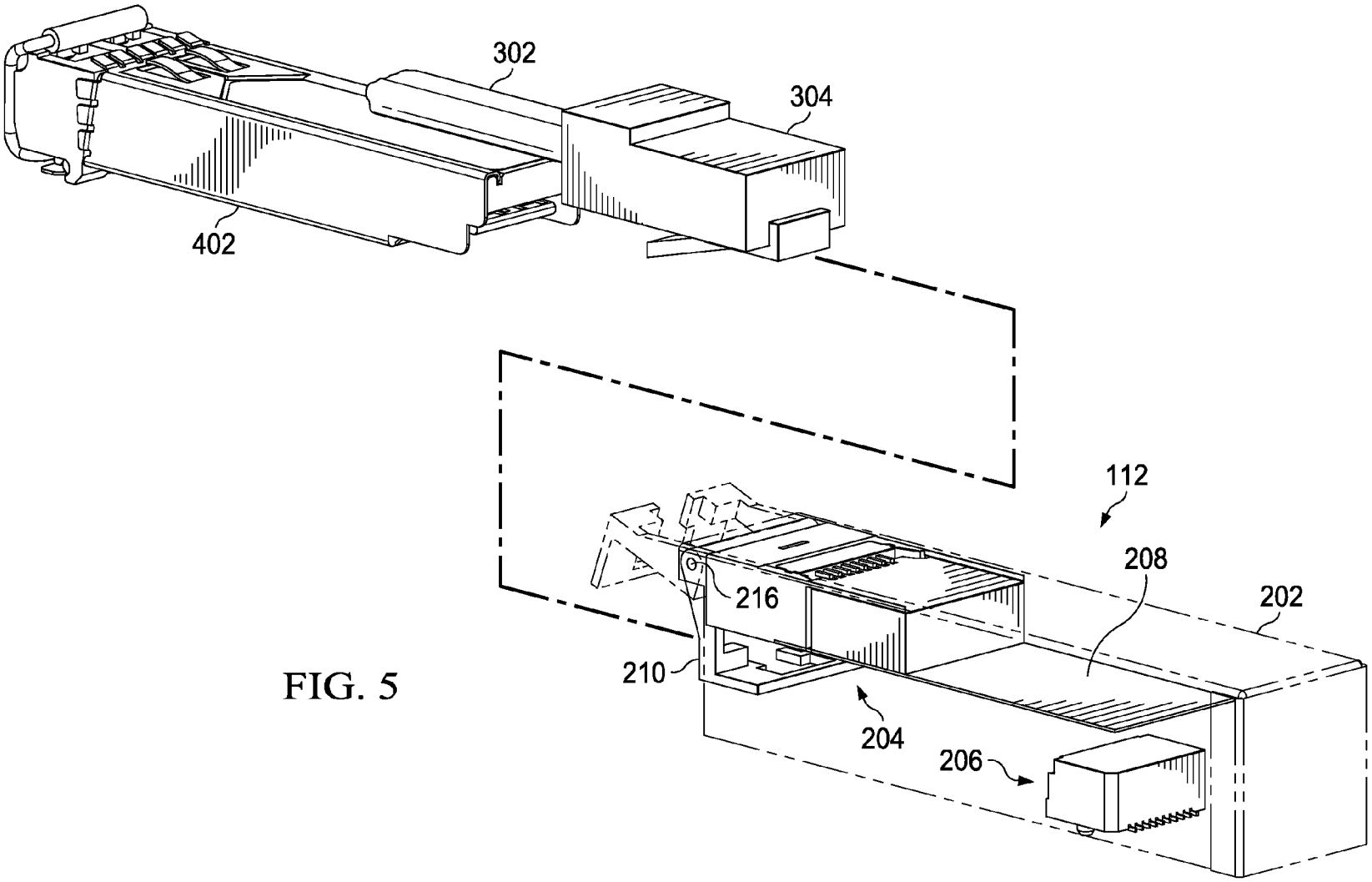
FIG. 5 illustrates a perspective view of the combination connector of FIGS. 2A and 2B depicting the overlapping footprints of connectors of different form factors that may be received by the combination connector, in accordance with embodiments of the present disclosure.

FIG. 4 illustrates a perspective view of combination connector 112 with movable portion 210 in a second position, in accordance with embodiments of the present disclosure. As shown in FIG. 4, in the second position movable portion 210 may allow connectors having a second form factor (e.g., a male SFP connector 402) and corresponding to second connector 206 to be inserted into combination connector 112 while preventing connectors having the first form factor corresponding to first connector 204 from being inserted into combination connector 112. Furthermore, in the second position, movable portion 210 may physically block access to pins of combination connector 112 corresponding to first connector 204, thus preventing pins of a second connector 206 from making contact with the pins of combination connector 112 corresponding to first connector 204.

By combining features of first connector 204 and second connector 206 into a single combination connector 112, the overall height of combination connector 112 may be reduced as compared to the combined heights of standalone assemblies for each of first connector 204 and 206. This advantage is demonstrated pictorially in FIG. 5, which shows how footprints of a first form factor (e.g., cable terminated with plug 304) and a second form factor (e.g., male SFP connector 402) as engaged in combination connector 112 overlap with one another. Thus, combination connector 112 provides for a low-profile system and method for receiving corresponding connectors having different form factors. Thus, having combination connector 112 with movable parts (e.g., movable portion 210) allows connector plug space allocations to overlap and thus compress the height of a connector as compared to stacking two separate connectors one over the other.

Figure 6A:
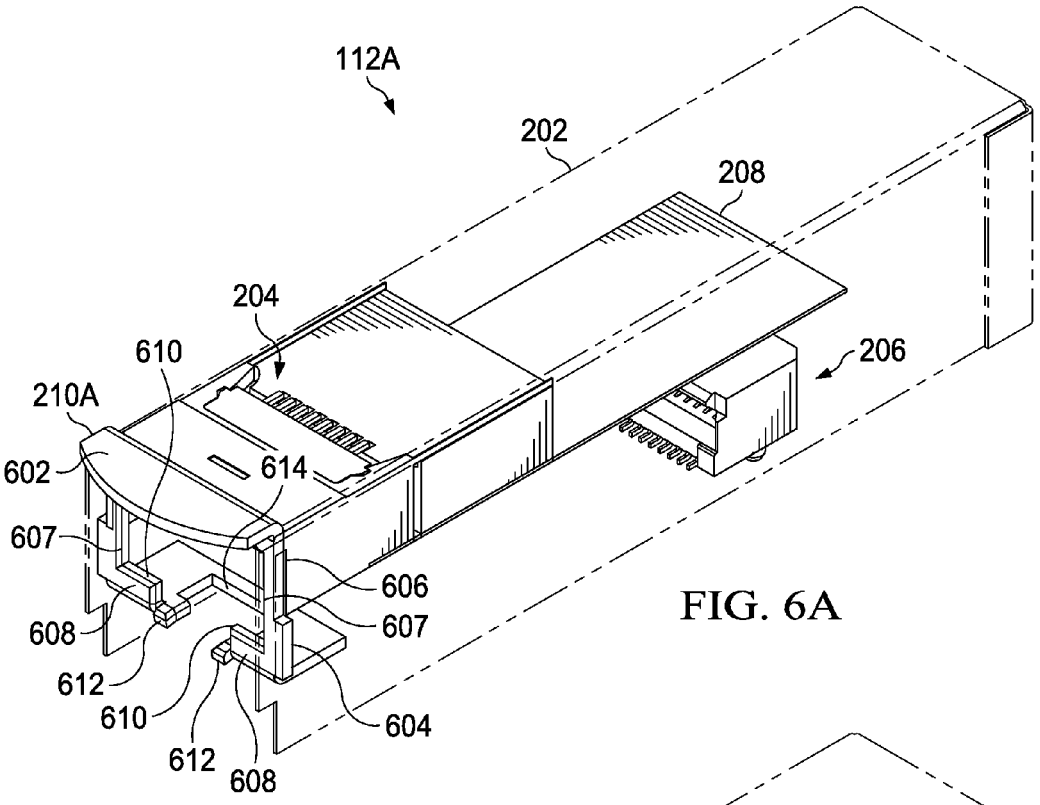
FIGS. 6A and 6B illustrate perspective views of another example combination connector, in accordance with embodiments of the present disclosure.
Figure 6B:
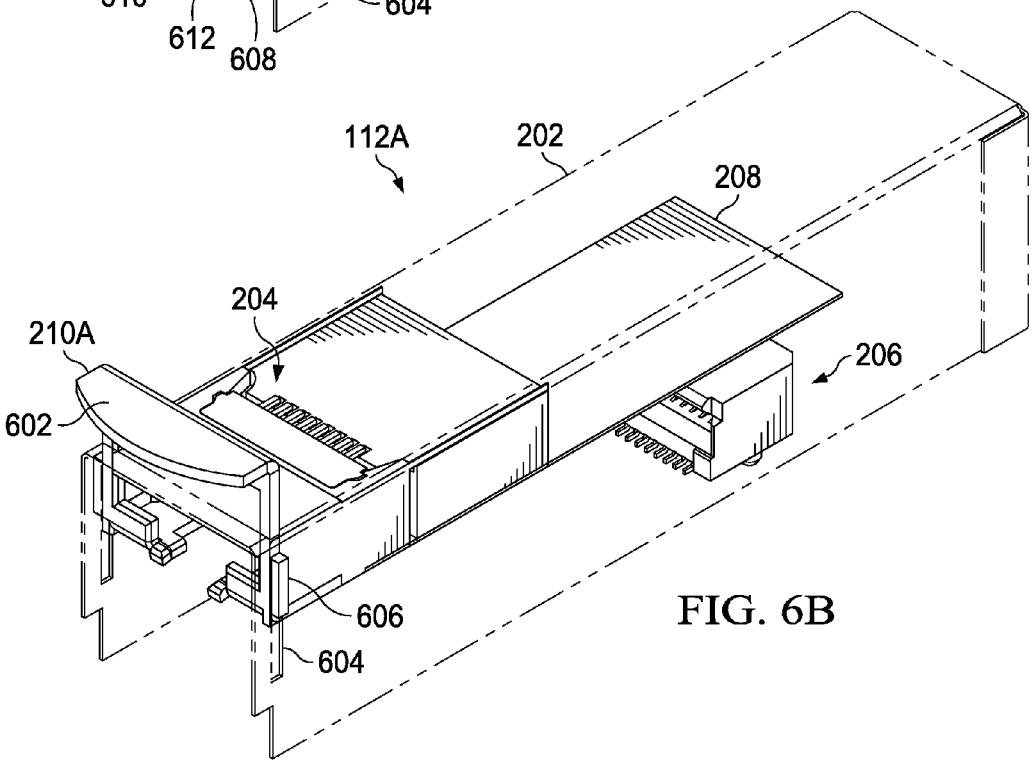

FIGS. 6A and 6B illustrate perspective views of another example combination connector 112A, in accordance with embodiments of the present disclosure. In some embodiments, combination connector 112A may be used in lieu of combination connector 112. Combination connector 112A may be, in many respects, similar in structure and function to combination connector 112, and thus, only the main differences between combination connector 112A and combination connector 112 may be discussed. Perhaps the most notable differences between combination connector 112A and combination connector 112 is that combination connector 112 may not include a movable portion 210 rotatably coupled to housing 202 via an axis 216. Instead, combination connector 112A may include a movable portion 210A slideably coupled to housing 202. Thus, as shown in FIGS. 6A and 6B, movable portion 210A may include bearings 606 configured to mechanically couple to guides 604 of housing 202, enabling movable portion 210A to slide between a first position as shown in FIG. 6A to a second position as shown in FIG. 6B, and vice versa. In some embodiments, movable portion 210A may include a tab 602, which may allow a person to apply either of an upward or downward force on such tab 602 to facilitate movement between the first position and the second position.

Similar to that described above with respect to movable portion 210, movable portion 210A may be positioned so as to define an identity of combination connector 112A. For example, in the first position (see, e.g., FIG. 6A), movable portion 210A may include features 607, 608, 610, 612, and 614 for mechanically guiding, gathering, and/or latching connectors having a first form factor (e.g., cable 302 terminated in plug 304) in order to mechanically and electrically couple such connectors to first connector 204 and/or may include features for preventing connectors having a second form factor corresponding to second connector 206 from being inserted into combination connector 112A. In a second position (see, e.g., FIG. 6B) movable portion 210A may allow connectors having the second form factor and corresponding to second connector 206 to be inserted into combination connector 112A while preventing connectors having the first form factor corresponding to first connector 204 from being inserted into combination connector 112A. Furthermore, in the second position, movable portion 210A may physically block access to pins of combination connector 112A corresponding to first connector 204, thus preventing pins of a second connector 206 from making contact with the pins of combination connector 112A corresponding to first connector 204.

Figure 7A:
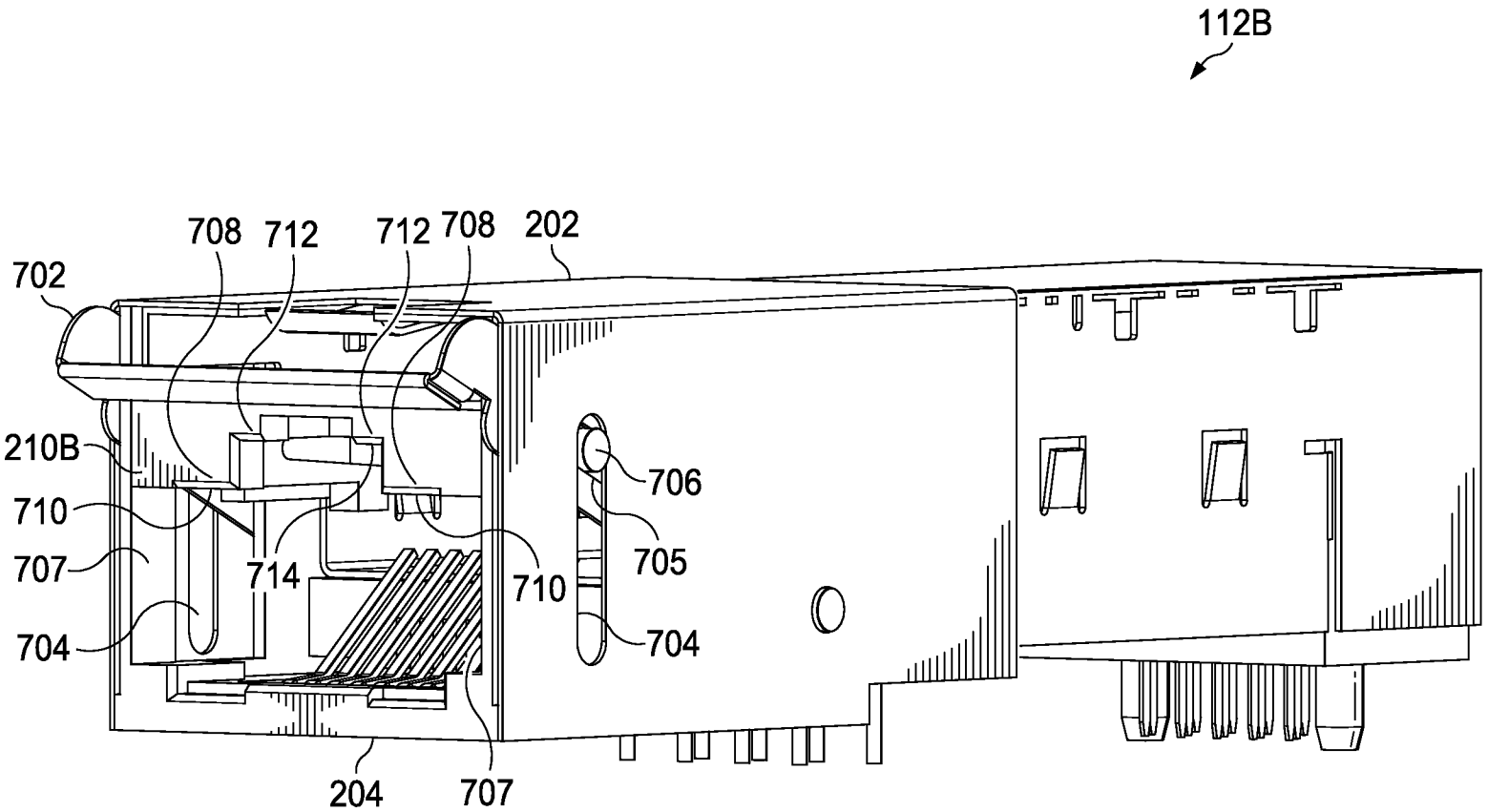
FIGS. 7A and 7B illustrate perspective views of another example combination connector, in accordance with embodiments of the present disclosure.
Figure 7B:
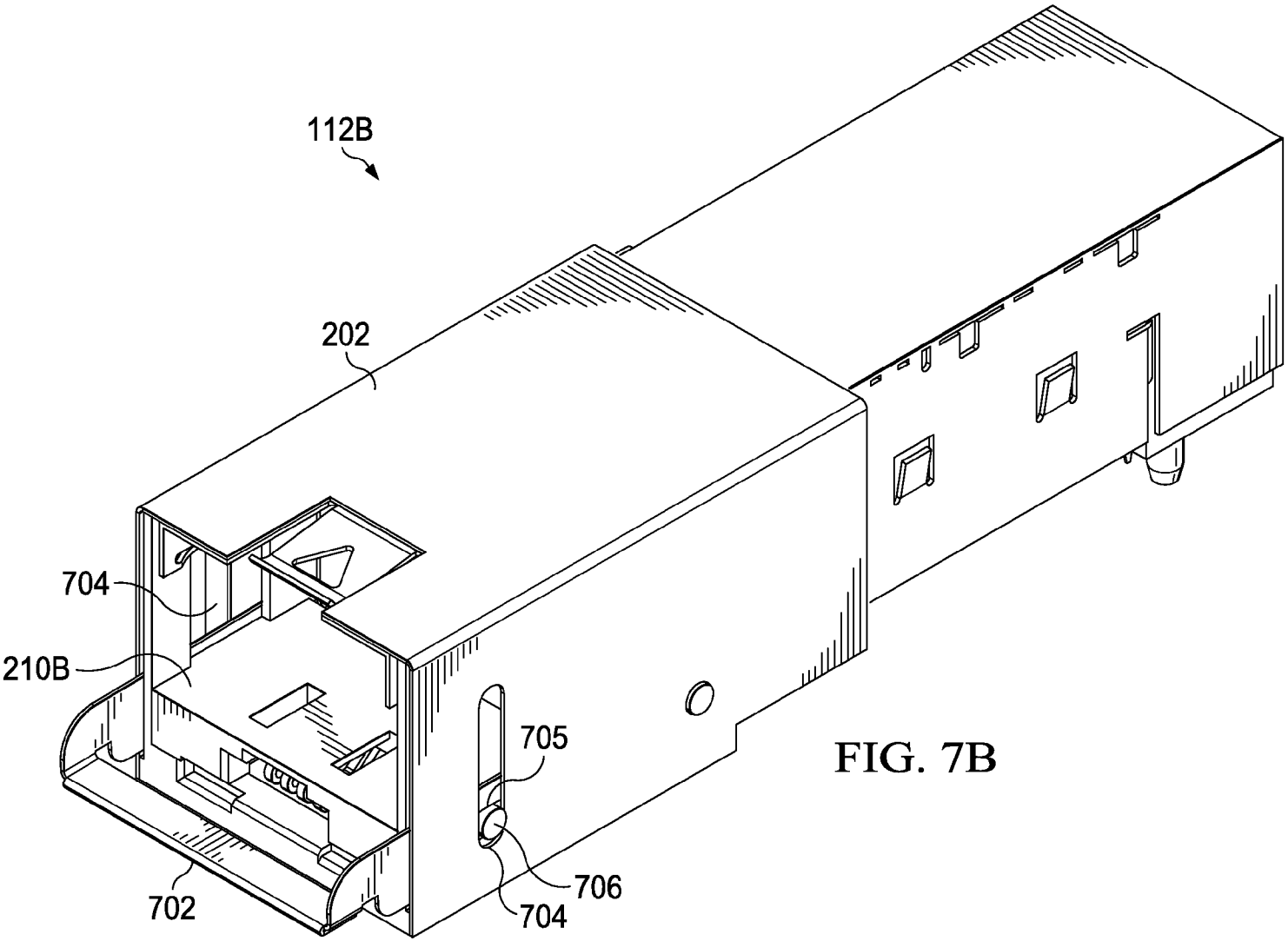

FIGS. 7A and 7B illustrate perspective views of another example combination connector 112B, in accordance with embodiments of the present disclosure. In some embodiments, combination connector 112B may be used in lieu of combination connector 112 or combination connector 112A. Combination connector 112B may be, in many respects, similar in structure and function to combination connector 112 and combination connector 112A, and thus, only the main differences between combination connector 112B and combination connector 112A may be discussed. Perhaps the most notable differences between combination connector 112B and combination connector 112A is that combination connector 112 may not include a movable portion 210A with a tab 602 formed from the same piece of material. Instead, combination connector 112B may include a movable portion 210B slideably coupled to housing 202 and also separately coupled to a handle 702. Thus, as shown in FIGS. 7A and 7B, movable portion 210B may include bearings 706 configured to mechanically couple to guides 704 of housing 202, enabling movable portion 210B to slide between a first position as shown in FIG. 7A to a second position as shown in FIG. 7B, and vice versa. Movable portion 210B may be coupled to bearings 706 via openings 705 (e.g. holes) each configured to receive a corresponding bearing 706 therethrough. Accordingly, a person to apply either of an upward or downward force on such handle 702 to facilitate movement between the first position and the second position.

Similar to that described above with respect to movable portion 210 and movable portion 210B, movable portion 210B may be positioned so as to define an identity of combination connector 112B. For example, in the first position (see, e.g., FIG. 7A), housing 202 include feature 707 and 714 and movable portion 210A may include features 708, 710, 712, and 714 for mechanically guiding, gathering, and/or latching connectors having a first form factor (e.g., cable 302 terminated in plug 304) in order to mechanically and electrically couple such connectors to first connector 204 and/or may include features for preventing connectors having a second form factor corresponding to second connector 206 from being inserted into combination connector 112B. In a second position (see, e.g., FIG. 7B) movable portion 210B may allow connectors having the second form factor and corresponding to second connector 206 (not shown in FIGS. 7A and 7B) to be inserted into combination connector 112B while preventing connectors having the first form factor corresponding to first connector 204 from being inserted into combination connector 112B. Furthermore, in the second position, movable portion 210B may physically block access to pins of combination connector 112B corresponding to first connector 204, thus preventing pins of a second connector 206 from making contact with the pins of combination connector 112B corresponding to first connector 204.

As used herein, when two or more elements are referred to as "coupled" to one another, such term indicates that such two or more elements are in electronic communication or mechanical communication, as applicable, whether connected indirectly or directly, with or without intervening elements.

This disclosure encompasses all changes, substitutions, variations, alterations, and modifications to the example embodiments herein that a person having ordinary skill in the art would comprehend. Similarly, where appropriate, the appended claims encompass all changes, substitutions, variations, alterations, and modifications to the example embodiments herein that a person having ordinary skill in the art would comprehend. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

All examples and conditional language recited herein are intended for pedagogical objects to aid the reader in understanding the disclosure and the concepts contributed by the inventor to furthering the art, and are construed as being without limitation to such specifically recited examples and conditions. Although embodiments of the present disclosure have been described in detail, it should be understood that various changes, substitutions, and alterations could be made hereto without departing from the spirit and scope of the disclosure.

What is claimed is:

1. An information handling system, comprising:

a processor;

an information handling resource communicatively coupled to the processor; and a combination connector comprising:

a housing;

a first connector housed within the housing and communicatively coupled to the information handling resource, the first connector configured to receive corresponding connectors of a first form factor and to communicatively couple a corresponding connector of the first form factor received by the first connector to the information handling resource; and a second connector housed within the housing and communicatively coupled to the information handling resource, the second connector configured to receive corresponding connectors of a second form factor and to communicatively couple a corresponding connector of the second form factor received by the second connector to the information handling resource;

wherein:

a first footprint of the corresponding connector of the first form factor as engaged with the first connector is overlapping with a second footprint of the corresponding connector of the second form factor as engaged with the second connector; and the first connector and the second connector each comprise electrically conductive pins which are fixed relative to the housing.

2. The information handling system of claim 1, wherein the information handling resource is a network interface.

3. The information handling system of claim 1, wherein the first connector comprises a jack configured to receive plug-terminated Ethernet over twisted pair cables.

4. The information handling system of claim 1, wherein the second connector comprises a female connector configured to receive corresponding male small form-factor pluggable connectors.

5. The information handling system of claim 1, wherein the combination connector further comprises a movable portion mechanically coupled to the housing and translatable between a first position and a second position such that:

in the first position, the movable portion includes features for mechanically guiding or latching connectors of the first form factor in order to mechanically and electrically couple connectors of the first form factor to the first connector; and in the second position, the movable portion includes features for mechanically guiding or latching connectors of the second form factor in order to mechanically and electrically couple connectors of the second form factor to the second connector.

6. The information handling system of claim 5, wherein, in the first position, the movable portion includes additional features for preventing connectors of the second form factor from being inserted into the combination connector.

7. The information handling system of claim 5, wherein, in the second position, the movable portion includes additional features for preventing pins of connectors of the second form factor from contacting pins corresponding to connectors of the first form factor.

8. The information handling system of claim 5, wherein the movable portion comprises one of:

a rotatable member rotatably coupled to the housing via an axis and configured to rotate between the first position and the second position; and a slidable member slidably coupled to the housing via one or more guides of the movable portion that mechanically couple to one or more corresponding bearings of the housing, and configured to slide between the first position and the second position.

9. A combination connector comprising:

a housing;

a first connector housed within the housing and configured to be communicatively coupled to an information handling resource, the first connector configured to receive corresponding connectors of a first form factor and to communicatively couple a corresponding connector of the first form factor received by the first connector to the information handling resource; and a second connector housed within the housing and configured to be communicatively coupled to the information handling resource, the second connector configured to receive corresponding connectors of a second form factor and to communicatively couple a corresponding connector of the second form factor received by the second connector to the information handling resource;

wherein:

a first footprint of the corresponding connector of the first form factor as engaged with the first connector is overlapping with a second footprint of the corresponding connector of the second form factor as engaged with the second connector; and the first connector and the second connector each comprise electrically conductive pins which are fixed relative to the housing.

10. The combination connector of claim 9, wherein the information handling resource is a network interface.

11. The combination connector of claim 9, wherein the first connector comprises a jack configured to receive plug-terminated Ethernet over twisted pair cables.

12. The combination connector of claim 9, wherein the second connector comprises a female connector configured to receive corresponding male small form-factor pluggable connectors.

13. The combination connector of claim 9, wherein the combination connector further comprises a movable portion mechanically coupled to the housing and translatable between a first position and a second position such that:

in the first position, the movable portion includes features for mechanically guiding or latching connectors of the first form factor in order to mechanically and electrically couple connectors of the first form factor to the first connector; and in the second position, the movable portion includes features for mechanically guiding or latching connectors of the second form factor in order to mechanically and electrically couple connectors of the second form factor to the second connector.

14. The combination connector of claim 13, wherein, in the first position, the movable portion includes additional features for preventing connectors of the second form factor from being inserted into the combination connector.

15. The combination connector of claim 13, wherein, in the second position, the movable portion includes additional features for preventing pins of connectors of the second form factor from contacting pins corresponding to connectors of the first form factor.

16. The combination connector of claim 13, wherein the movable portion comprises one of:

a rotatable member rotatably coupled to the housing via an axis and configured to rotate between the first position and the second position; and a slidable member slidably coupled to the housing via one or more guides of the movable portion that mechanically couple to one or more corresponding bearings of the housing, and configured to slide between the first position and the second position.

17. A method comprising:

housing a first connector within a housing wherein the first connector is configured to be communicatively coupled to an information handling resource, and the first connector is further configured to receive corresponding connectors of a first form factor and to communicatively couple a corresponding connector of the first form factor received by the first connector to the information handling resource; and housing a second connector within the housing and wherein the second connector is configured to be communicatively coupled to the information handling resource, and the second connector is further configured to receive corresponding connectors of a second form factor and to communicatively couple a corresponding connector of the second form factor received by the second connector to the information handling resource;

wherein the first connector and the second connector are housed such that:

a first footprint of the corresponding connector of the first form factor as engaged with the first connector is overlapping with a second footprint of the corresponding connector of the second form factor as engaged with the second connector; and the first connector and the second connector each comprise electrically conductive pins which are fixed relative to the housing.

18. The method of claim 17, wherein the information handling resource is a network interface.

19. The method of claim 17, wherein the first connector comprises a jack configured to receive plug-terminated Ethernet over twisted pair cables.

20. The method of claim 17, wherein the second connector comprises a female connector configured to receive corresponding male small form-factor pluggable connectors.

21. The method of claim 17, further comprising mechanically coupling a movable portion to the housing such that the movable portion is translatable between a first position and a second position such that:

in the first position, the movable portion includes features for mechanically guiding or latching connectors of the first form factor in order to mechanically and electrically couple connectors of the first form factor to the first connector; and in the second position, the movable portion includes features for mechanically guiding or latching connectors of the second form factor in order to mechanically and electrically couple connectors of the second form factor to the second connector.

22. The method of claim 21, wherein, in the first position, the movable portion includes additional features for preventing connectors of the second form factor from being inserted into the combination connector.

23. The method of claim 21, wherein, in the second position, the movable portion includes additional features for preventing pins of connectors of the second form factor from contacting pins corresponding to connectors of the first form factor.

24. The method of claim 21, wherein the movable portion comprises one of:

a rotatable member rotatably coupled to the housing via an axis and configured to rotate between the first position and the second position; and a slidable member slidably coupled to the housing via one or more guides of the movable portion that mechanically couple to one or more corresponding bearings of the housing, and configured to slide between the first position and the second position;

the first position, the movable portion includes additional features for preventing connectors of the second form factor from being inserted into the combination connector.

* * * * *